United States Patent [19]

Östman

[11] Patent Number: 4,608,121

[45] Date of Patent: Aug. 26, 1986

[54] PROCESS FOR CONTINUOUS DIGESTION OF FINELY-DIVIDED MATERIAL WITH HEAT CAPACITY FLOWS OF SUBSTANTIALLY THE SAME MAGNITUDE

[75] Inventor: Per H. Östman, Jorvas, Finland

[73] Assignee: Ekono Oy, Helsinki, Finland

[21] Appl. No.: 450,905

[22] Filed: Dec. 20, 1982

[30] Foreign Application Priority Data

Dec. 31, 1981 [FI] Finland ..... 814229

[51] Int. Cl.[4] ..... D21C 7/10; D21C 7/14

[52] U.S. Cl. ..... 162/19; 162/43; 162/44; 162/47; 162/250

[58] Field of Search ..... 162/47, 61, 19, 60, 162/68, 52, 238, 237, 251, 250, 29, 40, 41, 42, 43, 44, 246

[56] References Cited

U.S. PATENT DOCUMENTS

| | | | |
|---|---|---|---|
| 2,824,800 | 2/1958 | Rosenblad | 162/47 |
| 3,427,218 | 2/1969 | Richter | 162/19 |
| 4,071,399 | 1/1978 | Prough | 162/19 X |

OTHER PUBLICATIONS

Schmidt et al., "Material and Energy Balances" Prentice-Hall Inc.; Englewood Cliffs, 1962, pp. 169–173.

*Primary Examiner*—Steve Alvo

*Attorney, Agent, or Firm*—Tilton, Fallon, Lungmus & Chestnut

[57] ABSTRACT

A process for continuous digestion of wood chips which are passed through a heating zone, a digesting zone and a cooling zone in contact with cooking liquor is disclosed. In this process the wood chips are fed into and the liquid phase removed from the input end of the heating zone in such relative quantities that their heat-capacity flows are of approximately the same order of magnitude.

4 Claims, 2 Drawing Figures

PROCESS FOR CONTINUOUS DIGESTION OF FINELY-DIVIDED MATERIAL WITH HEAT CAPACITY FLOWS OF SUBSTANTIALLY THE SAME MAGNITUDE

BACKGROUND OF THE INVENTION

The present invention relates to a process for continuous digestion at elevated temperature and pressure of finely-divided material by passing said finely-divided material successively through a heating zone, at least one digesting zone and a cooling zone in contact with a liquid phase.

Processes are already well-known in which a finely-divided material, such as wood chips, is digested at elevated temperature and pressure by means of a digesting liquid, such as white liquor, by passing the wood chips from the top downwards through a continuously operating cooking tower divided into different zones for heating and impregnation of the chips, digesting of the heated and impregnated chips and for washing and cooling of the pulp thereby obtained. Such digesting towers are customarily equipped with strainers for extraction of liquid from the solid material at the beginning and end of the zones and possibly also at intermediate positions. The washing liquid has been introduced at the outlet end of the washing zone, near the point at which the pulp is withdrawn, so that the washing liquid flows in counter-current to the pulp in the washing zone. White liquor has been fed into the product liquor withdrawn from the digesting zone in such a manner that the principal direction of flow of the liquid in the digesting zone is either the same as or counter to that of the chips therein.

In processes known heretofore the chips and white liquor have been heated either by directly heating the chips with primary steam and steam obtained from expansion of the black liquor or by mixing the chips with white liquor which is indirectly heated by steam.

Although by means of various improvements to the internal heat recovery in modern continuously operating cookers it has been possible to reduce the heat consumption to approx. 2–3 GJ/tonne of pulp, it has now surprisingly been discovered that a considerable further reduction in the heat consumption can be achieved.

The object of the present invention is thus to achieve a process for the digestion of finely-divided material at elevated temperature and possibly pressure with the use of considerably less heat than heretofore.

According to the present invention there is provided a process for digesting finely-divided material at elevated temperature and pressure wherein finely-divided material and liquid is fed and liquid phase withdrawn from the inlet end of a heating zone in such relative quantities that their heat capacity flows are substantially of the same magnitude.

DESCRIPTION OF THE PREFERRED EMBODIMENTS

Figure 1:
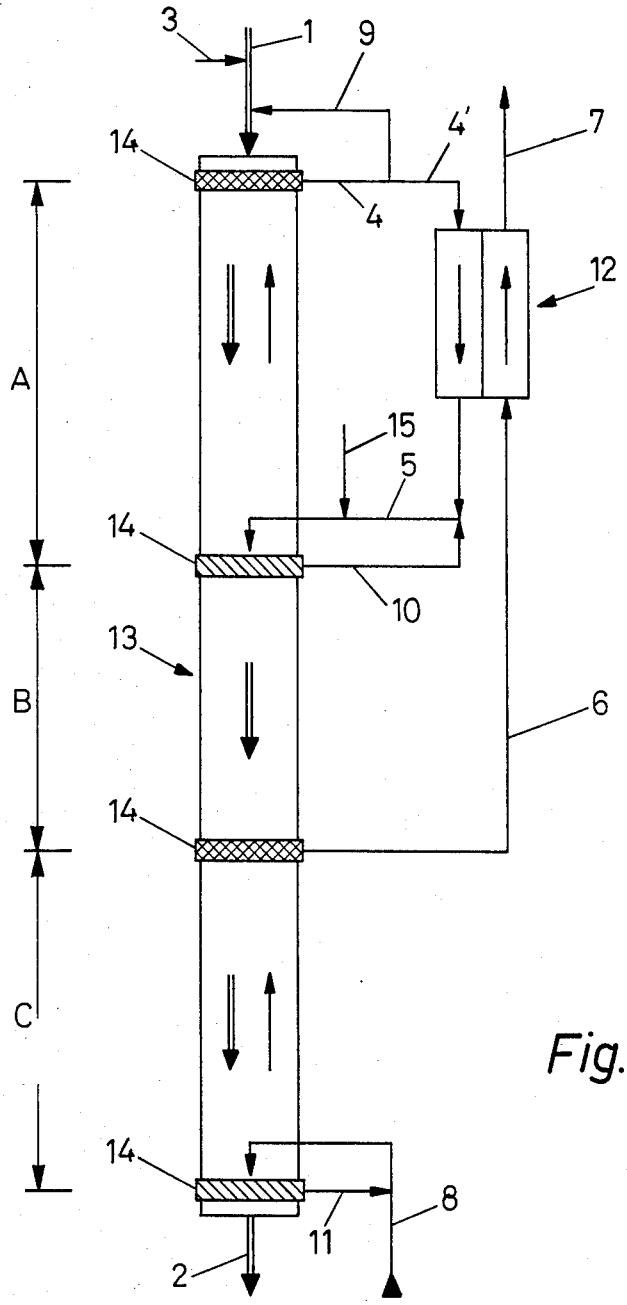
FIG. 1 illustrates diagrammatically a vertical cross-sectional view of a digester for application of the present invention.

The subject process is particularly suitable for the cooking or digesting of wood to obtain cellulose, in which case the raw material is suitably in the form of chips and the digesting takes place mainly in the liquid phase, as in the sulphate, soda and sulphite methods. The digesting can be carried out either in a single stage or in several stages and the digesting liquor can consist either of an aqueous solution containing inorganic digesting chemicals or the digesting liquor can consist mainly of an organic solvent (e.g. ethanol). The subject process can also be applied to processes in which wood is cooked to obtain sugar as the main product (hydrolysis) for the production of pentose or hexose based products.

Besides lower heat consumption, it is possible with the present invention to carry out the treatment with heat and chemicals under milder conditions in order to lessen undesired chemical attack and decomposition products and also encrustations and blockages. Moreover, it is possible, inter alia, to reduce the requirement for cooking chemicals.

In order to be able to achieve the desired result as far as possible the present process is based on the following principles:

(1) the heat recovery should take place without change of phase, which means that the transfer of heat from the output flow to the input flow should take place preferably by direct heat transfer between the chips and a suitable liquid where this is possible without undesired mixing of the various chemicals and otherwise by indirect heat transfer between liquids in a heat exchanger.

(2) The heat exchange should take place in counter-current flow and should be so arranged that the heat-capacity flow of the heat recipient is approximately equal to the heat-capacity flow of the heat source. When these two heat-capacity flows are equal the greatest heat recovery is achieved. In processes known heretofore these two heat-capacity flows are of a quite different order of magnitude. Thus, for example, the heat-capacity flow of the weak liquor is approx. 3.5 times the heat-capacity flow of the chips when the chips are preheated by expansion vaporization of the weak liquor.

(3) The transport of the various liquids should be arranged so that liquids with a higher content of active cooking chemical than desired are not withdrawn from the digesting process.

The term "heat-capacity flow" is used in this context to mean the sum over all components of the specific heat of the component times it weight flow (the unit is, e.g., W/°C.).

In the present invention the finely-divided material is accordingly heated before digestion by a liquid, the principal direction of flow of said liquid being counter-current with respect to the solid material and the input of said finely-divided material and the withdrawal of the liquid phase from the input end of the heating zone being so controlled that their heat-capacity flows are of approximately the same order of magnitude.

The digestion process is suitably started by first supplying such a quantity of heat to the liquid phase fed into the input end of the digesting zone that the temperature in the digesting zone arises to the desired level and thereafter regulating the amount of liquid phase withdrawn from the input end of the heating zone so that said supply of extra heat can be reduced as far as possible. During continued operation said heat-capacity flows are maintained approximately equal suitably by regulating the amount of liquid phase withdrawn from the input end of the heating zone, so that the temperature difference between said liquid phase and the finely-divided material with liquid fed into the input end of the heating zone is kept substantially constant.

In order to recover heat from the product liquor withdrawn from the output end of the digesting zone said liquor is suitably brought into indirect counter-current heat-exchange contact with fresh digesting liquor which is to be fed into the input end of digesting zone or with liquor containing digesting chemicals which is withdrawn from the input end of the heating zone and which is thereafter fed into the input end of the digesting zone. The flows of the liquors brought into indirect counter-current heat-exchange contact are also in this case suitably regulated so that their heat-capacity flows are approximately of the same order of magnitude, from which it follows that also the heat-capacity flow of the wash water fed into the output of the colling zone will be approximately equal to the heat-capacity flow of the pulp together with its associated liquor content withdrawn from the output of the cooling zone.

The various zones can naturally be formed by separate installations coupled together.

The digester illustrated in FIG. 1 consists of a tall, closed tower 13 which by means of extraction strainers 14 is divided into three zones, viz. a heating zone A, a digesting zone B and a cooling zone C, one above the other and in the order named from top to bottom.

The solid material is fed in continuously via the pipe line 1 to the top of the cooker 13, i.e. to the input end of the heating zone A, and is passed successively first through the heating zone A, then through the digesting zone B and thereafter through the cooling zone C, after which the digested and cooled solid material is fed out from the bottom of the digester 13 via the pipe line 2, i.e. from the output end of the cooling zone C. A flow of liquor 4 is withdrawn by means of the extraction strainer 14, said flow being approximately the same order of magnitude as the heat-capacity flow of the solid material fed in through the pipe line 1 and the white liquor mixed therewith via the pipe line 3 together with the recirculated liquor fed in via the branch line 9. The remainder of the liquor withdrawn from the input end of the heating zone A is, however, fed via the pipe line 4' to the heat exchanger 12 where it is brought into indirect counter-current heat-exchange contact with hot, spent product liquor 6 which is withdrawn from the lower end of the digesting zone B via the extraction strainer 14 and which is removed from the heat exchanger via the pipe line 7. The liquor heated in the heat exchanger 12 is returned via the pipe 5 to the output end of the heating zone in the vicinity of the extraction strainer 14 between the heating zone A and the digesting zone B. Part of the liquor is withdrawn here through said extraction strainer and returned via the pipe 10 to the pipe line 5 in order to obtain better distribution of the liquor over the cross-section of the digester. Additional heat, shown diagrammatically by the arrow 15, is supplied to the liquor in the pipe line 5 in order to achieve the desired digesting temperature.

The flow of the spent product liquor 7 is regulated so that the corresponding heat-capacity flow is equal to the heat-capacity flow of the liquor flow in the pipe line 4'.

The flows are so regulated that the liquor in the heating zone A flows principally in a direction counter to that of the solid material and in the digesting zone B principally in the same direction as the solid material.

In order to cool and wash the material which comes from the digesting zone B, i.e. to displace the product liquor from the dissolved solid material, cooler wash liquor is fed via the pipe line 8 into the cooling zone C near the bottom thereof in the vicinity of the extraction strainer 14, whereupon part of the wash liquor is withdrawn via the pipe 11 and reunited with the wash liquor in the pipe line 8.

Figure 2:
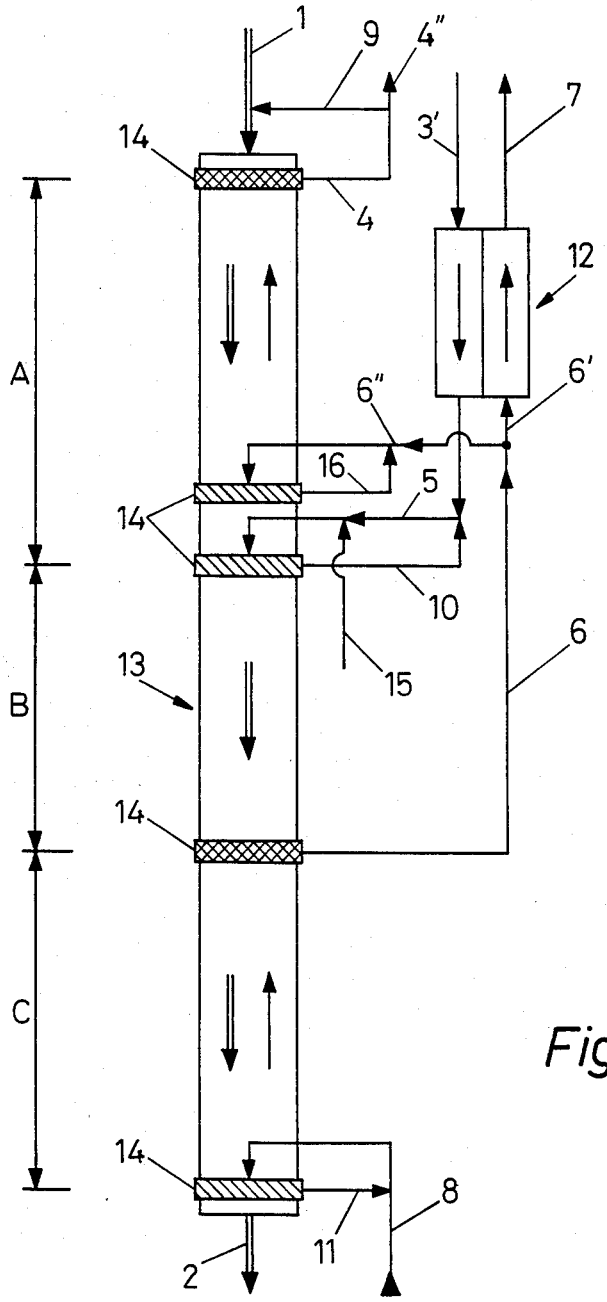
FIG. 2 illustrates a similar vertical view of another digester which is particularly suitable from the point of view of heat economy and which can be used for application of an alternative process according to the present invention.

In contrast to the embodiment shown in FIG. 1, in the embodiment shown in FIG. 2 the fresh digesting liquor is not mixed directly with the finely-divided material in the pipe line 1 but instead is first led via the pipe line 3' to the heat exchanger 12 in order to be heated by indirect counter-current heat-exchange contact with the hot spent product liquor withdrawn from the lower end of the digesting zone B, after which said first digesting liquor is fed via the pipe 5 into the lower end of the heating zone A in the vicinity of the extraction strainer 14 between the heating zone A and the digesting zone B.

In order to displace air from the finely-divided material in the pipe line 1 before it is fed into the top of the digester 13, part of the liquor 4 withdrawn by means of the extraction strainer 14 fitted at the input end of the heating zone A is fed via the pipe line 9 to the pipe line 1.

In order to regulate the liquor flows in the lower part of the heating zone A an additional extraction strainer 14 is fitted some distance above the extraction strainer 14 between the heating zone and the digesting zone B, part of the hot spent product liquor 6 withdrawn from the lower end of the digesting zone B being fed in via the pipe line 6'' in the vicinity of said additional extraction strainer while the remainder of said liquor is fed via the pipe line 6' to the heat exchanger 12. In this case too part of this liquor is withdrawn via the pipe line 16 and returned to the pipe line 6''.

If the quantity of liquor fed into the heating zone A via the pipe line 6'' is less than the quantity of liquor which flows through the heating zone A in a direction counter to that of the solid material, then the deficiency which arises will automatically be made from the digesting liquor which is fed into the output end of the heating zone via the pipe line 5. In this case the solid material will be exposed to active digesting chemicals especially during the final phase of the heating. If, however, the quantity of liquor fed into the heating zone a little above its output end via the pipe line 6'' is greater than the quantity of liquor which flows through the heating zone A in a direction counter to that of the solid material, then the excess which arises will automatically mix with the fresh digesting liquor fed into the heating zone via the pipe line 5 and will then flow through the digesting zone B. By means of regulating the quantity of liquor which is fed into the heating zone A a little above its output end via the pipe line 6'' it is thus possible to achieve the desired concentration profile of active digesting chemicals in the digesting and heating zones.

In order to achieve the desired digesting temperature the necessary additional heat is supplied in suitable fashion to the liquor in the pipe line 5, as is shown diagrammatically by the arrow 15.

The present invention can naturally be applied to so-called counter-current digestion, i.e. when the digesting liquor is fed in at what is the output end for the solid material and is passed through the digesting zone B in counter-current together with wash liquor from the cooling zone C.

The invention is described in greater detail below with the aid of an example.

EXAMPLE

The extent of the heat saving that can be achieved by the process according to the invention in comparison with known technology depends on a number of factors such as the type of digestion process, the raw material, the digesting liquor etc. The design and performance of the installation used for chemicals recovery also affects the final heat saving for the whole production process.

In the production of cellulose from softwood chips by the sulphate method the following process data are normal:

| | |
|---|---|
| Pulp yield | 47% |
| Cooking temperature | 170° C. |
| Moisture content of wood | 50% |
| Temperature of wood | 10° C. |
| White liquor | |
| charge expressed as active alkali ($Na_2O$) | 17% |
| concentration | 98 g/l |
| temperature | 85° C. |
| Temperature of wash water | 70° C. |
| Washing loss | 10 kg $Na_2SO_4$/tonne |
| Dilution | 2.5 tonnes water/tonne |

In this case the primary heat requirement for a process according to FIG. 1 is 0.49 GJ/tonne and for a process according to FIG. 2 0.32 GJ/tonne. With the same assumptions a cooking process according to known technology requires 1.86 GJ/tonne.

Because the temperature of the residual liquor in the digesting processes according to FIGS. 1 and 2 (83° C. and 78° C. respectively) is lower than in the normal digesting process (102° C.) the heat required for the evaporation of the residual liquor in the process of FIG. 1 is 0.51 GJ/tonne greater and in the process of FIG. 2 0.59 GJ/tonne greater than the heat required for evaporation of the residual liquor in the normal digesting process. In comparison with known technology the total heat saving for a digesting process according to FIG. 1 is in this case 0.86 GJ/tonne and for a cooking process according ot FIG. 2 0.95 GJ/tonne. For a sulphate pulp mill with an annular production of 340000 tonnes this would respresent a saving in energy costs of 6.6 MFmk/annun or 7.3 MKmk/annum respectively at an oil price of 1000 Fmk/tonne.

What is claimed is:

1. A process for continuous digestion at elevated temperature of finely-divided material by means of passing said finely-divided material through a heating zone, one or more digesting zones and a cooling zone in contact with a liquid phase, comprising feeding the finely-divided material into and withdrawing liquid phase from the inlet end of the heating zone in such relative quantities that their heat-capacity flows are of substantially the same magnitude, mixing fresh digesting liquor and the finely-divided material before being fed into the inlet end of the heating zone and bringing at least a part of the liquid phase withdrawn from the inlet end of the heating zone into indirect counter-current heat-exchange contact with spent hot liquid phase withdrawn from the outlet end of the digesting zone in such relative quantities that the heat-capacity flows of the liquid phases are of substantially the same magnitude and returning said part of the withdrawn liquid phase to the outlet part of said heating zone, and feeding cold displacement liquid into the outlet end of the cooling zone in such a net quantity that its heat-capacity flow is substantially of the same magnitude as the heat-capacity flow of the digested material and the liquid content thereof withdrawn from the outlet end of the cooling zone.

2. The process according to claim 1, in which the remainder of the liquid phase withdrawn from the inlet end of the heating zone is mixed with the finely-divided material before the finely-divided material is fed into the inlet end of the heating zone.

3. The process according to claim 1, in which first so much heat is supplied to the liquid phase fed into the inlet end of the digesting zone that a desired temperature is achieved in the digesting zone and thereafter the quantity of liquid phase withdrawn from the inlet end of the heating zone is so regulated that the extra heat requirement is reduced to a minimum.

4. The process according to claim 1, in which the quantity of liquid phase withdrawn from the inlet end of the heating zone is so regulated that the difference between the temperature of the liquid phase and the temperature of the finely-divided material is maintained substantially constant.

* * * * *